US006686575B2

(12) United States Patent
Kim

(10) Patent No.: US 6,686,575 B2
(45) Date of Patent: Feb. 3, 2004

(54) MICROWAVE OVEN HAVING SIDE WAVE DISPERSING UNIT

(75) Inventor: Sun-Ki Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/259,764

(22) Filed: Sep. 30, 2002

(65) Prior Publication Data

US 2003/0230570 A1 Dec. 18, 2003

(30) Foreign Application Priority Data

Jun. 14, 2002 (KR) ..... 2002-33086

(51) Int. Cl.[7] ..... H05B 6/74
(52) U.S. Cl. ..... 219/751; 219/745; 219/746
(58) Field of Search ..... 219/751, 745, 219/746, 748, 749, 756

(56) References Cited

U.S. PATENT DOCUMENTS 2,748,239 A * 5/1956 Long et al. ..... 219/751
4,140,888 A * 2/1979 Baron et al. ..... 219/751
4,173,716 A 11/1979 Takahashi ..... 219/751
4,249,058 A * 2/1981 Lentz et al. ..... 219/751
5,877,479 A * 3/1999 Yu ..... 219/751
5,998,775 A * 12/1999 Sung ..... 219/751

FOREIGN PATENT DOCUMENTS

JP 54-72532 * 6/1979 ..... 219/751

* cited by examiner

*Primary Examiner*—Philip H. Leung
(74) *Attorney, Agent, or Firm*—Staas & Halsey LLP

(57) ABSTRACT

A microwave oven effectively and uniformly cooks large-sized food even though the food inhibits a proper rotation of a cooking tray in a cooking cavity of the microwave oven. An upper wave dispersing unit is provided at a top wall of the cooking cavity and primarily disperses microwaves from the top wall into the cooking cavity. A side wave dispersing unit is provided at a second sidewall of the cooking cavity opposite to a first sidewall of the cooking cavity. The first sidewall partitions the cooking cavity from a machine room of the microwave oven. The side wave dispersing unit secondarily disperses the primarily dispersed microwaves in the cooking cavity. The second sidewall of the cooking cavity has a recess which receives a fan of the side wave dispersing unit. A cover is installed in front of the recess to cover the fan of the side wave dispersing unit. The cover is made of a transparent material and allows a user to view a rotational operation of the side wave dispersing unit.

21 Claims, 4 Drawing Sheets

MICROWAVE OVEN HAVING SIDE WAVE DISPERSING UNIT

CROSS-REFERENCE TO RELATED APPLICATIONS

This application claims the benefit of Korean Patent Application No. 2002-33086 filed on Jun. 14, 2002, in the Korean Industrial Property Office, the disclosure of which is incorporated herein by reference.

BACKGROUND OF THE INVENTION

1. Field of the Invention

The present invention relates to microwave ovens, and more particularly, to a microwave oven which evenly cooks food seated on a cooking tray in a cooking cavity of the microwave oven, even where the cooking tray is not rotated.

2. Description of the Related Art

Generally, a microwave oven is an electrically operated oven, which heats and/or cooks food laid in its cooking cavity using high-frequency electromagnetic waves. The high-frequency electromagnetic waves are generated by oscillation of a magnetron installed in a machine room of the microwave oven. That is, during a cooking operation, the magnetron installed in the machine room irradiates the high-frequency electromagnetic waves ("microwaves") through the cooking cavity. The microwaves penetrate the food so as to repeatedly change the molecular arrangement of moisture laden in the food, causing the molecules of the moisture to vibrate and generate frictional heat within the food to cook the food. Such a microwave oven is typically provided with both a wave guide and a wave dispersing unit which guide the microwaves from the magnetron and disperse the microwaves to the food seated in the cooking cavity. The microwave oven also has a turntable-type cooking tray which seats food thereon and is rotated at a low speed during the cooking operation.

FIG. 1 shows the construction of a conventional microwave oven. As shown in the drawing, the conventional microwave oven comprises a cabinet 1 which forms the outer appearance of the microwave oven, and a cooking cavity 2 which is defined inside the cabinet 1 to form a cooking chamber to cook food therein. A machine room 3 is defined inside the cabinet 1 at a position beside the cooking cavity 2 such that the machine room 3 is partitioned from the cavity 2. The machine room 3 receives a variety of devices used to generate microwaves.

A cooking tray 4 is set on a bottom of the cooking cavity 2 and seats food thereon. The cooking tray 4 is rotated by a tray motor 5 at a predetermined speed. A tray guide 6, with a plurality of rollers 7, is set under the cooking tray 4 to rotatably support the tray 4 on the bottom of the cooking cavity 2.

The devices installed in the machine room 3 include a magnetron 8 which generates the microwaves, and a wave guide 9 which guides the microwaves from the magnetron 8 into the cooking cavity 2. The magnetron 8 is installed at an inlet of the wave guide 9, while a wave dispersing unit 10 is provided at an outlet of the wave guide 9. The wave dispersing unit 10 disperses the microwaves, guided thereto under the guide of the wave guide 9, into the cooking cavity 2.

During an operation of the microwave oven, the microwaves generated from the magnetron 8 are transmitted into the cooking cavity 2 through the wave guide 9. In addition, the cooking tray 4 loaded with food "F" thereon is rotated at a low speed under the guide of the tray guide 6 by a rotating force of the tray motor 5. The food "F" laid on the cooking tray 4 is heated and cooked by the microwaves.

However, since the wave guide 9 is placed at a top wall of the cooking cavity 2, the wave dispersing unit 10 installed at the outlet of the wave guide 9 is limited in its operational effect. That is, where the microwaves from the magnetron 8 reach the outlet of the wave guide 9, the wave dispersing unit 10 only disperses the microwaves downward from the outlet of the wave guide 9 into the cooking cavity 2. Accordingly, the microwaves are not effectively transmitted to a lower and side parts of the food "F" laid on the cooking tray 4.

Where the size of the food "F" to be cooked is large, it may inhibit a proper rotation of the cooking tray 4. In such a case, the cooking operation must be performed without rotating the cooking tray 4. Therefore, the microwaves cannot be evenly radiated to the entire parts of the food "F." Furthermore, it is almost impossible to transmit an effective quantity of the microwaves to the lower part of the food "F." The microwave oven, having such a wave dispersing unit at the top of the cooking cavity 2, thus undesirably lengthens a cooking time and fails to accomplish a desired cooking result.

Additionally, such an arrangement of the wave dispersing unit 10 at the top of the cooking cavity 2 does not allow a user outside the microwave oven to see a rotation of the wave dispersing unit 10. Therefore, the user cannot visually confirm the rotating action of the wave dispersing unit 10. Accordingly, an operation of the conventional microwave oven does not provide a sense of beauty which is expected to be enhanced by a visual confirmation of the rotation of the wave dispersing unit 10 inside the cooking cavity 2. This degrades market competitiveness of the conventional microwave oven.

SUMMARY OF THE INVENTION

Accordingly, it is an object of the present invention to provide a microwave oven which evenly irradiates microwaves to the entire parts of food seated in its cooking cavity.

Another object of the present invention is to provide a microwave oven, which effectively cooks large-sized food even though the food inhibits a proper rotation of a cooking tray in the cooking cavity, and which improves the appearance of the cooking cavity, thus enhancing the market competitiveness of the microwave ovens.

Additional objects and advantages of the invention will be set forth in part in the description which follows and, in part, will be obvious from the description, or may be learned by practice of the invention.

To achieve the above and other objects of the present invention, there is provided a microwave oven comprising a cabinet which forms an outer appearance of the oven, a cooking cavity defined inside the cabinet, a machine room defined inside the cabinet and partitioned from the cooking cavity, and a side wave dispersing unit which is provided at a sidewall of the cooking cavity and disperses microwaves into the cooking cavity.

The microwave oven further comprises a magnetron which is installed in the machine room and generates the microwaves. The machine room is partitioned from the cooking cavity by a second sidewall of the cooking cavity, and the side wave dispersing unit is provided at the sidewall opposite from the second sidewall of the cooking cavity.

The microwave oven further comprises a cover which is installed in front of the side wave dispersing unit and transmits the microwaves to/from the side wave dispersing unit and the cooking cavity.

The sidewall of the cooking cavity includes a recess which seats the side wave dispersing unit therein.

The microwave oven further comprises an upper wave dispersing unit which is provided at an upper portion of the cooking cavity and downwardly disperses the microwaves from the upper portion to a lower portion of the cooking cavity, and a wave guide which extends from an upper portion of the machine room to the upper portion of the cooking cavity and guides the microwaves to the cooking cavity. The upper wave dispersing unit is installed at an outlet of the wave guide.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
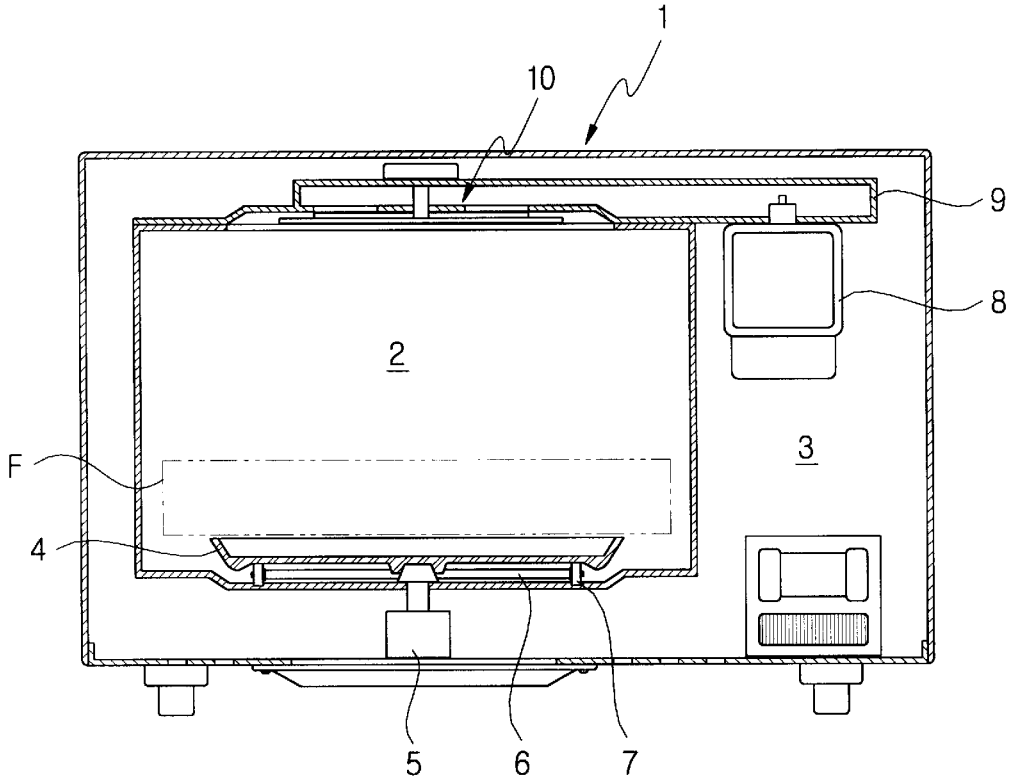
FIG. 1 (Prior Art)
FIG. 1 is a sectional view showing the construction of a conventional microwave oven having one wave dispersing unit at a top wall of a cooking cavity of the microwave oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
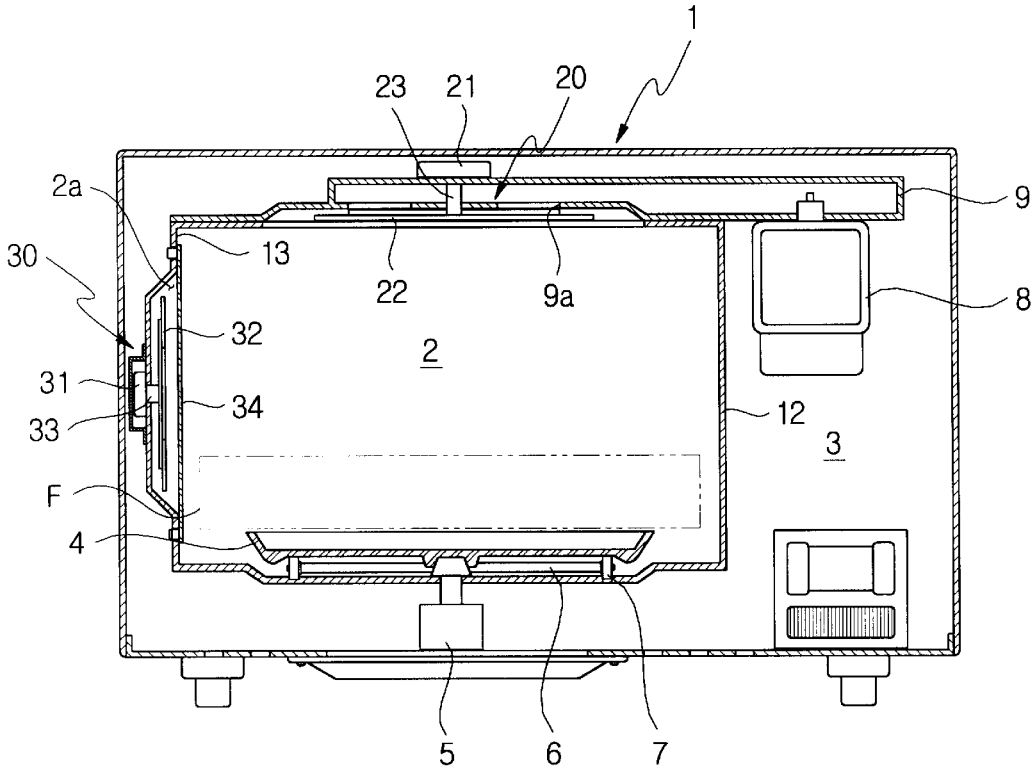
FIG. 2 is a sectional view showing the construction of a microwave oven having a wave dispersing unit at a top wall and a sidewall of a cooking cavity in accordance with an embodiment of the present invention.

FIG. 2 shows a microwave oven having a wave dispersing unit at each of a top wall and a sidewall of its cooking cavity in accordance with an embodiment of the present invention. As shown in the drawing, the microwave oven comprises a cabinet 1 which forms the outer appearance of the oven, and a cooking cavity 2 and a machine room 3 which are defined in the cabinet 1 and partitioned from each other. A wave guide 9 extends from an upper portion of the machine room 3 to the top wall of the cooking cavity 2. A cooking tray 4 is set on a bottom of the cooking cavity 2 and seats food thereon. The cooking tray 4 is rotated by a tray motor 5 at a predetermined speed. A tray guide 6, having a plurality of rollers 7 along its edge, is set under the cooking tray 4 to rotatably support the cooking tray 4 on the bottom of the cooking cavity 2.

A magnetron 8 generates microwaves, and is installed at an inlet of the wave guide 9 which is positioned at the upper portion of the machine room 3, while an opening 9*a* is formed at an outlet of the wave guide 9 which is positioned at the top wall of the cooking cavity 2. The wave guide 9 discharges the microwaves into the cooking cavity 2 through the opening 9*a*. An upper wave dispersing unit 20 is provided at a position adjacent to the opening 9*a* of the wave guide 9.

The upper wave dispersing unit 20 comprises a first drive motor 21, a first wave dispersing fan 22, and a first rotating shaft 23. The first drive motor 21 generates a drive force, and the first wave dispersing fan 22 is rotated by the drive force of the first drive motor 21 to disperse the microwaves into the cooking cavity 2. The rotating shaft 23 connects the first drive motor 21 to the first wave dispersing fan 22, transmitting the drive force of the first drive motor 21 to the first wave dispersing fan 22.

During an operation of the microwave oven, the microwaves generated by the magnetron 8 are led into the wave guide 9 through the inlet of the guide 9, and flow under the guide of the wave guide 9 to reach the upper wave dispersing unit 20 provided at the outlet of the guide 9. The microwaves are, thereafter, dispersed into the cooking cavity 2 by the first wave dispersing fan 22.

The microwave oven of the present invention also has a side wave dispersing unit 30 which secondarily disperses the microwaves inside the cooking cavity 2. That is, the side wave dispersing unit 30 is installed at a sidewall of the cooking cavity 2 such that it forces the microwaves, primarily dispersed into the cooking cavity 2 by the upper wave dispersing unit 20, to be secondarily dispersed into the cooking cavity 2. Accordingly, the microwaves are effectively transmitted to the entire parts of food "F" laid on the cooking tray 4 in the cooking cavity 2. The side wave dispersing unit 30 is provided at a second sidewall 13 of the cooking cavity 2 opposite to a first sidewall 12 of the cooking cavity 2. The first sidewall 12 partitions the cooking cavity 2 from the machine room 3.

The side wave dispersing unit 30 comprises a second drive motor 31, a second wave dispersing fan 32, and a second rotating shaft 33. The second drive motor 31 generates a drive force which rotates the second wave dispersing fan 32 so as to disperse the microwaves into the cooking cavity 2. The second rotating shaft 33 connects the second drive motor 31 to the second wave dispersing fan 32, transmitting the drive force of the second drive motor 31 to the second wave dispersing fan 32.

The second sidewall 13 of the cooking cavity 2 has a recess 2*a* which is recessed outward from the cooking cavity 2. The second wave dispersing fan 32 of the side wave dispersing unit 30 is arranged in the recess 2*a*. Therefore, the side wave dispersing unit 30 is not projected into the cooking cavity 2.

The second drive motor 31 of the side wave dispersing unit 30 is mounted to an outside surface of the second sidewall 13 of the cooking cavity 2. The second rotating shaft 33 extends from the second drive motor 31, passes through the second sidewall 13, and is connected to the second wave dispersing fan 32.

To prevent an undesired introduction of impurities, such as oil smoke generated from the food "F" during a cooking operation, to the second wave dispersing fan 32 of the side wave dispersing unit 30, a cover 34 covers the second wave dispersing fan 32. The structure for locking the cover 34 to the second sidewall 13 of the cooking cavity 2 will be described in detail with reference to FIGS. 3 and 4.

Figure 3:
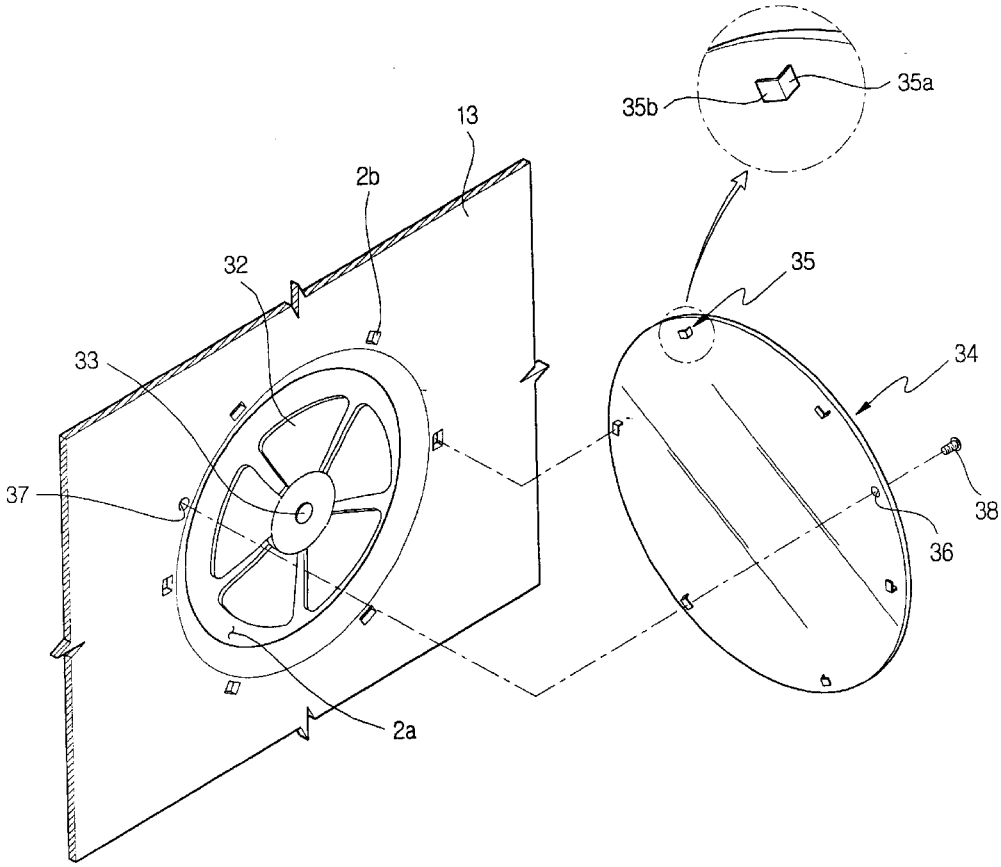
FIG. 3 is an exploded perspective view illustrating a structure for locking a cover to the sidewall of the cooking cavity so as to cover a wave dispersing fan of the side wave dispersing unit shown in FIG. 2.
Figure 4:
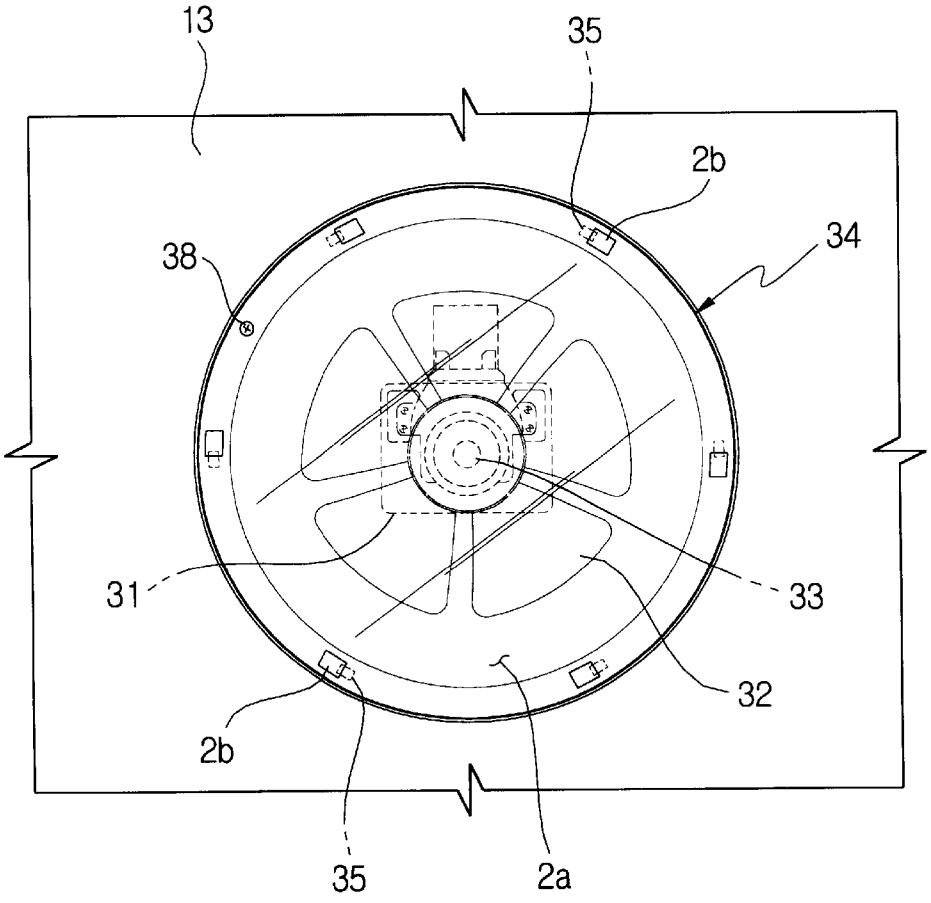
FIG. 4 is a plan view showing the cover of FIG. 3 completely locked to the sidewall of the cooking cavity according to the present invention.

FIG. 3 shows the structure for locking the cover 34 to the second sidewall 13 of the cooking cavity 2 so as to cover the second wave dispersing fan 32 of the side wave dispersing unit 30. FIG. 4 shows that the cover 34 is completely locked to the second sidewall 13 of the cooking cavity 2.

As shown in FIG. 3, the cover 34 of the side wave dispersing unit 30 is locked to an inside surface of the second sidewall 13 at a position in front of the recess 2*a*, so as to cover the second wave dispersing fan 32 installed in the recess 2*a*. While the recess 2*a* and the cover 34 are shown to have a circular shape, it is understood that the shape of the recess 2*a* and the cover 34 is not limited to the circular shape, and that the shape may be changed without affecting the functionality of the recess 2*a* and the cover 34. For example, the recess 2*a* and the cover 34 may have a polygonal shape, such as a square, or an oval shape.

To lock the circular cover 34 to the second sidewall 13 of the cooking cavity 2, a plurality of L-shaped hooks 35 are arranged at regular intervals on an inside surface of the cover 34 along an edge of said cover 34. The same number of hooking holes 2*b* as that of the L-shaped hooks 35 are formed at regular intervals on the second sidewall 13 along an edge of the recess 2*a*, and engage with the corresponding L-shaped hooks 35. Screw holes 36 and 37 are formed on the cover 34 and the second sidewall 13, respectively. The cover 34 is screwed to the second sidewall 13 to cover the recess 2*a* using a setscrew 38 after primarily locking the cover 34 to the second sidewall 13 at the L-shaped hooks 35 and the hooking holes 2*b*. It is understood that more than one screw hole and setscrew can be formed and used, respectively.

Each of the L-shaped hooks 35 includes a rib part 35*a* which extends perpendicularly from the inside surface of the cover 34 to a predetermined length, and a flange part 35*b* which integrally extends from an end of the rib part 35*a* in a direction which is perpendicular to the length of the rib part 35*a* and parallel to the cover 34. Each of the hooking holes 2*b* has a size slightly larger than that of the flange part 35*b*, so as to have the L-shaped hooks 35 pass through the corresponding hooking holes 2*a*, where the cover 34 is locked to the second sidewall 13.

Where the cover 34 is assembled to the second sidewall 13 of the cooking cavity 2 in front of the recess 2*a*, the cover 34 is primarily locked to the edge of the recess 2*a*. In such a case, the L-shaped hooks 35 of the cover 34 are inserted into the hooking holes 2*b* of the second sidewall 13. Thereafter, the cover 34 is slightly rotated relative to the fixed second sidewall 13 in a direction where the flange parts 35*b* of the L-shaped hooks 35 are extended, until the rib parts 35*a* of the L-shaped hooks 35 are stopped by edges of the hooking holes 2*b*. Accordingly, the cover 34 is locked to the second sidewall 13 of the cooking cavity 2 as shown in FIG. 4. Afterwards, the cover 34 is screwed to the second sidewall 13 by the setscrew 38, which passes through the screw hole 36 of the cover 34 and is threaded into the screw hole 37 of the second sidewall 13. Therefore, the cover 34 is completely locked to the second sidewall 13 of the cooking cavity 2 while covering the recess 2*a*.

The cover 34 is made of a material capable of transmitting microwaves to the side wave dispersing unit 30. That is, the cover 34 effectively transmits the microwaves primarily dispersed into the cooking cavity 2 by the upper wave dispersing unit 20, to the side wave dispersing unit 30. The material of the cover 34 can be selected from transparent materials which are capable of transmitting the microwaves to the side wave dispersing unit 30. Accordingly, the cover 34 can be made of a plastic material, a glass material, or a ceramic material so as to allow a user to see an operation of the side wave dispersing unit 30.

Where the side wave dispersing unit 30 is operated, the user outside the microwave oven can view a low speed rotating action of the second wave dispersing fan 32 arranged inside the transparent cover 34. The transparent cover 34 allows the user to see a visual effect of the side wave dispersing unit 30, in addition to allowing the user to visually confirm an operational effect of the side wave dispersing unit 30. Where a desired pattern or design is formed on a surface of the transparent cover 34, the visual effect of the side wave dispersing unit 30 is further enhanced.

An operational effect of the above-mentioned microwave oven will be described herein below with reference to FIG. 2.

Where the microwave oven is turned on after loading the food "F" in the cooking cavity 2, microwaves are generated by the magnetron 8 and flow to the upper wave dispersing unit 20 under the guide of the wave guide 9. In such a case, the first rotating shaft 23 of the upper wave dispersing unit 20 is rotated by the first drive motor 21, thus rotating the first wave dispersing fan 22 at a predetermined constant speed. The first wave dispersing fan 22 primarily disperses the microwaves into the cooking cavity 2. In the cooking cavity 2, a part of the primarily dispersed microwaves is radiated to the food "F," while another part of the primarily dispersed microwaves is radiated to the side wave dispersing unit 30.

The microwaves, radiated to the side wave dispersing unit 30 after being primarily dispersed into the cooking cavity 2 by the upper wave dispersing unit 20, are secondarily dispersed into the cooking cavity 2 by the second wave dispersing fan 32 of the side wave dispersing unit 30. The second wave dispersing fan 32 is rotated at a determined constant speed by the second drive motor 31. The secondarily dispersed microwaves are radiated to the food "F" in the cooking cavity 2.

Where the microwaves are primarily and secondarily dispersed into the cooking cavity 2 by the two wave dispersing units 20 and 30 as described above, the cooking tray 4 loaded with the food "F" is rotated at a low speed. The primarily and secondarily dispersed microwaves are thus evenly transmitted to the entire parts of the food "F," and uniformly and quickly cook the food "F."

Where the size of the food "F" laid on the cooking tray 4 is large, such that it contacts inner surfaces of the front and rear walls of the cooking cavity 2 during a rotation of the cooking tray 4, the cooking operation must be performed with the cooking tray 4 being stopped. Even where a cooking operation is performed with the cooking tray 4 stopped as described above, the microwave oven of the present invention effectively and evenly transmits the microwaves to the entire parts of the food "F" because the upper and side wave dispersing units 20 and 30 primarily and secondarily disperse the microwaves into the cooking cavity 2. Therefore, the microwave oven accomplishes a desired cooking effect regardless of whether the cooking tray 4 is rotated.

In several experiments, the microwave oven of the present invention provided an improved cooking effect of food over a conventional microwave oven, particularly with the food having a large size, and where a cooking tray was not rotated during a cooking operation of the microwave oven.

As described above, the present invention provides a microwave oven having an upper wave dispersing unit provided at a top wall of a cooking cavity, and a side wave dispersing unit provided at a sidewall of the cooking cavity. Since the two wave dispersing units primarily and secondarily disperse microwaves into the cooking cavity, it is possible to evenly radiate the microwaves to the entire parts of food laid on a cooking tray. Therefore, the microwave oven effectively, quickly and desirably cooks the food laid on the cooking tray even where the cooking tray is not rotated.

Additionally, a wave dispersing fan provided in the side wave dispersing unit is covered with a transparent cover which transmits the microwaves therethrough. Due to the transparency of the cover, a user outside the microwave oven is able to visually confirm an operation of the side wave dispersing unit, enhancing the operational performance of the microwave oven. Additionally, the visual effect of the operation of the wave dispersing fan enhances the market competitiveness of the microwave oven.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a cabinet which forms an outer appearance of the oven;

a cooking cavity defined inside the cabinet and including a bottom wall to hold food;

a machine room defined inside the cabinet and partitioned from the cooking cavity;

a side wave dispersing unit is provided at a first sidewall adjacent to the bottom wall of the cooking cavity which disperses microwaves the cooking cavity; and an upper wave dispersing unit Provided at an upper portion of the cooking cavity which disperses the microwaves from the upper portion to a lower portion of the cooking cavity.

2. The microwave oven according to claim 1, further comprising a magnetron which is installed in the machine room and generates the microwaves, wherein:

the machine room is partitioned from the cooking cavity by a second sidewall of the cooking cavity, and the side wave dispersing unit is provided at the first sidewall opposite from the second sidewall of the cooking cavity.

3. The microwave oven according to claim 2, further comprising a wave guide which extends from an upper portion of the machine room to the upper portion of the cooking cavity, and guides the microwaves from the magnetron to the cooking cavity, wherein:

the magnetron is installed at an inlet of the wave guide placed in the machine room, and the upper wave dispersing unit installed at an outlet of the wave guide placed on the cooking cavity.

4. The microwave oven according to claim 1, further comprising a cover which is installed in front of the side wave dispersing unit and transmits the microwaves between the side wave dispersing unit and the cooking cavity.

5. The microwave oven according to claim 4, wherein the cover is made of a transparent material which visually transmits an operation of the side wave dispersing unit therethrough.

6. The microwave oven according to claim 4, further comprising hooking holes formed on the sidewall of the cooking cavity, wherein the cover includes hooks which are arranged along an edge of the cover, and engage with the corresponding hooking holes to lock the cover to the first sidewall of the cooking cavity.

7. The microwave oven according to claim 6, further comprising at least one screw hole formed on each of the cover and the first sidewall of the cooking cavity so as to attach the cover to the first sidewall of the cooking cavity.

8. The microwave oven according to claim 4, wherein the cover is made of a visually transparent material including one of a transparent plastic, glass, ceramic, and any combination thereof.

9. The microwave oven according to claim 8, wherein the cover includes a design pattern which enhances a visual effect of an operation of the side wave dispersing unit.

10. The microwave oven according to claim 1, wherein the first sidewall of the cooking cavity includes a recess which seats the side wave dispersing unit therein.

11. The microwave oven according to claim 10, wherein the side wave dispersing unit comprises:

a wave dispersing fan installed in the recess;

a drive motor which is installed at an outside surface of the recess and generates a drive force which rotates the wave dispersing fan; and a rotating shaft which connects the drive motor to the wave dispersing fan.

12. The microwave oven according to claim 1, wherein the upper wave dispersing unit primarily disperses the microwaves from the upper portion to the lower portion of the cooking cavity, and the side wave dispersing unit secondarily disperses the primarily dispersed microwaves in the cooking cavity.

13. The microwave oven according to claim 1, wherein the side wave dispersing unit secondarily disperses the microwaves which are primarily dispersed from the upper portion of the cooking cavity to the lower portion of the cooking cavity.

14. The microwave oven according to claim 13, further comprising a wave guide which guides the microwaves from the machine room to the upper portion of the cooking cavity.

15. The microwave oven according to claim 14, wherein the upper wave dispersing unit is provided at the upper portion of the cooking cavity and primarily disperses the microwaves from the upper portion to the lower portion of the cooking cavity.

16. The microwave oven according to claim 15, further comprising:

a magnetron which generates the microwaves;

a cooking tray which seats food thereon; and a tray rotor which rotates the cooking tray.

17. A microwave oven, comprising:

a cabinet which forms an outer appearance of the oven;

a cooking cavity defined inside the cabinet;

a machine room which is defined inside the cabinet and partitioned from the cooking cavity;

a wave guide which is arranged on an upper portion of the cooking cavity and guides microwaves from the machine room to the upper portion of the cooking cavity;

an upper wave dispersing unit which is provided at the wave guide and primarily disperses the microwaves from the upper portion to a lower portion of the cooking cavity; and a side wave dispersing unit which is provided at a sidewall of the cooking cavity and secondarily disperses the primarily dispersed microwaves in the cooking cavity.

18. The microwave oven according to claim 17, further comprising a cover which is installed in front of the side wave dispersing unit and transmits the microwaves to and from the side wave dispersing unit and the cooking cavity.

19. The microwave oven according to claim 12, wherein the cover is made of a transparent material which visually transmits an operation of the side wave dispersing unit therethrough.

20. The microwave oven according to claim 18, wherein the cover is made of a visually transparent material including one of a transparent plastic, glass, ceramic, and any combination thereof.

21. The microwave oven according to claim 17, wherein:

the sidewall of the cooking cavity includes a recess which receives the side wave dispersing unit, and the cover covers the recess.

* * * * *

UNITED STATES PATENT AND TRADEMARK OFFICE

CERTIFICATE OF CORRECTION

PATENT NO. : 6,686,575 B2
DATED : February 3, 2004
INVENTOR(S) : Sun-Ki Kim

It is certified that error appears in the above-identified patent and that said Letters Patent is hereby corrected as shown below:

Column 7,
Line 16, after “unit”, delete “is”;
Line 18, after “microwaves” insert -- in --;
Line 19, change “Provided” to -- provided --; and Column 8,
Line 53, change “12” to -- 18 --.

Signed and Sealed this

Eighteenth Day of May, 2004

JON W. DUDAS
*Acting Director of the United States Patent and Trademark Office*